United States Patent [19]

Lasar

[11] 4,127,236

[45] Nov. 28, 1978

[54] MEAT FLAKING MACHINE

[76] Inventor: William Lasar, 7322 Rio Hondo, Downey, Calif. 90241

[21] Appl. No.: 832,633

[22] Filed: Sep. 12, 1977

[51] Int. Cl.[2] ..... B02C 18/22

[52] U.S. Cl. ..... 241/37.5; 241/280; 241/285 B

[58] Field of Search ..... 241/36, 37.5, 280, 281, 241/282, 285 A, 285 B

[56] References Cited

U.S. PATENT DOCUMENTS

| | | | |
|---|---|---|---|
| 1,533,217 | 4/1925 | Steiner | 241/280 X |
| 1,752,160 | 3/1930 | Erl | 241/282 |
| 2,149,289 | 3/1939 | Hall | 241/285 B UX |
| 2,821,228 | 1/1958 | Hall | 241/280 X |
| 3,043,514 | 8/1977 | Peterson, Jr. | 241/37.5 X |
| 3,419,223 | 12/1968 | Morin | 241/37.5 X |
| 3,530,914 | 9/1970 | Lasar | 241/281 |

*Primary Examiner*—Howard N. Goldberg

*Attorney, Agent, or Firm*—Fulwider, Patton, Rieber, Lee & Utecht

[57] ABSTRACT

A meat flaking machine for reducing a block of meat to meat flakes, which includes a lower housing containing a power driven cutting drum for cutting the meat block into flakes. An upper housing includes a charging chamber communicating with the lower housing and having a vertical entrance opening. The block of meat is placed on a loading tray, which is pivotally connected to the upper housing, and is transferred through the entrance into the charging chamber by pivoting the loading tray upwardly until it extends along the opening. A pressure plate, mounted within the upper housing, is moved manually by an external handle into contact with the upper end of the meat block to press it downwardly onto the cutting drum. A mechanical interlock ensures that the loading tray cannot load a meat block into the charging chamber unless the pressure plate has been moved to a position out of the way of the block.

3 Claims, 9 Drawing Figures

MEAT FLAKING MACHINE

BACKGROUND OF THE INVENTION

This invention relates to a meat flaking machine for cutting a block of meat into meat flakes.

In the preparation of ground meat, such as hamburger meat at the retail level, it is customary to reduce the meat from initial large pieces, such as sides or blocks of meat, to smaller pieces or flakes which may be fed into the grinding machine. In recent years, there has been increasing importation into this country of meat in the form of frozen, generally rectangular blocks weighing about 30 pounds. In the retailing of ground meat, for example, at the butcher shop or in the meat department of a supermarket, there has arisen a need for a meat flaking machine which can be used to reduce such meat blocks to meat flakes suitable for feeding into a meat grinding machine, usually along with fresh meat, to produce ground meat. The flaking machine of the present invention is intended to meet this need.

The present machine has some resemblances to a much larger type of flaking machine disclosed in an earlier patent to the present applicant, U.S. Pat. No. 3,530,914 for "Meat Flaker". Such earlier machine was intended primarily for meat wholesalers and much larger commercial installations and, while highly suitable for those purposes, would usually be in excess of the requirements of the average supermarket meat department, retail butcher shop or the like. Such prior machine, among other differences, utilized power operated loading equipment whereas the loading of the present machine is intended for manual operation, which raises special problems.

In particular, with a manually operated machine, it is necessary to provide a loading tray for loading the meat blocks into the machine and also a hand operated pressure plate for maintaining manual pressure against the meat block sufficient to force it through the cutting mechanism which reduces the block to flakes. With such a manually operated arrangement, a problem could arise if the machine should be loaded with a block of meat while the pressure plate is still in the down position which it occupied at the conclusion of cutting of the previous block of meat. In that event the newly inserted block of meat could completely jam all the parts in position requiring the machine to be taken apart by a mechanic before it could be operated.

It is also particularly important with a meat flaking machine for use by persons such as supermarket operators who are not skilled in, or particularly familiar with, meat cutting equipment, that any such machine should facilitate easy cleaning at the conclusion of each day's operations to maintain a hygenic installation.

SUMMARY OF THE INVENTION

A meat flaking machine according to the present invention is intended for operation by butcher shops, supermarket meat departments and other comparable installations where the sizes of the pieces of meat to be flaked are not sufficiently great to justify a fully powered commercial machine and, instead, manual loading of the machine and manual application of pressure to the meat during flaking, are to be relied upon.

The present machine includes a lower housing in which is mounted a power driven cutting drum for cutting a block of meat into meat flakes. An upper housing, mounted on the lower housing, has a charging chamber with a vertical entrance opening in which a loading tray is pivotally mounted. The block of meat is placed on the loading tray while the latter is in a loading position projecting outwardly from the housing. By raising the loading tray, the meat block is transferred into the charging chamber from which it moves down into contact with the cutting drum in the lower housing. A pressure plate positioned within the charging chamber is moved, by an external handle, into contact with the upper end of the meat block to press the block against the drum, as flaking proceeds. Such a flaking machine, which requires only manual operation for loading the meat into the machine and pressing it against the cutting drum, satisfies the requirements of the types of installation previously described.

A further aspect of the invention is intended to ensure that a block of meat cannot be fed into the charging chamber while the pressure plate is in the operative position extending across the chamber. Such a precaution is necessary because, otherwise, the block of meat entering in the chamber would be barred from leaving by the pressure plate. Further it would not thereafter be possible to reopen the loading tray to withdraw the meat and raise the pressure plate because the loading tray would be jammed in the charging position by the presence of the meat, leading to a complete blockage of the machine that would require it to be taken apart to remove the meat block. This problem is avoided in the invention by providing a mechanical detent system which ensures that the block of meat cannot be fed into the charging chamber on the top of the pressure plate. This feature is particularly valuable in the environment described where the labor operating the machine usually has little mechanical skill or aptitude Another aspect of the present machine, which is particularly important from the user's point of view, is that it is particularly easy to gain access to the cutting drum and the interior parts of the machine at the end of the day for cleaning purposes. To facilitate cleaning the upper housing is hinged to the lower housing. By hinging the upper housing away from the lower housing to a cleaning position, access is provided to the interior portions of the two housings and the cutting drum. Similarly, to provide access to the lower housing on the downstream side of the cutting drum, a hinged lid is provided which can be raised upwardly to expose the cutting drum and the interior of the housing, for cleaning.

In order to prevent accidental damage to a person's hand by the cutting drum during a period when either the upper housing or the lid of the lower housing is raised, an electrical interlock system takes power off the motor driving the cutting drum whenever either of those parts of the equipment is pivoted to the cleaning position. In this way, the possibility of injury to persons using the machinery is avoided.

The foregoing, and other advantages, of the invention are described more fully in the detailed description which follows.

BRIEF DESCRIPTION OF THE DRAWINGS

A meat flaking machine constructed in accordance with the preferred embodiment of the invention is illustrated in the accompanying drawings, which are as follows.

DETAILED DESCRIPTION

Figure 1:
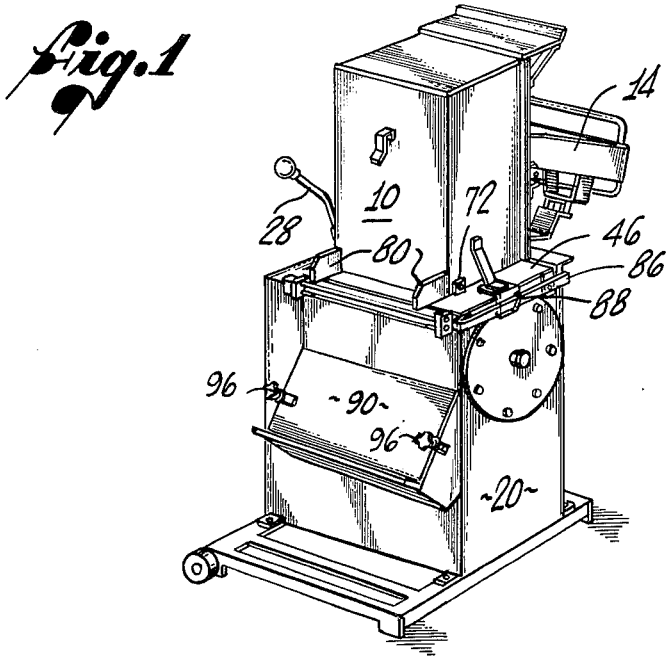
FIG. 1 shows a perspective view, from the rear side, of the flaking machine.

A meat flaking machine, constructed according to the invention, includes a rectangular upper housing 10 (FIG. 1) having a vertical opening 12 in its front wall, in which is mounted a vertically pivoting, loading tray 14. A block of frozen (tempered) meat 16 is placed on the loading tray in its loading position (FIG. 2) and it is then pivoted upwardly to a charging position (FIG. 3) to transfer the block of meat into a charging chamber 18 constituted by the interior of the upper housing. The upper housing rests on a lower housing 20 having a vertical passageway 22 in which is mounted a power driven cutting drum 24 having blades about its periphery. The block of meat passes out of the charging chamber into contact with the cutting drum which cuts the meat into flakes and delivers it through the passageway to a container (not shown). As the meat block becomes reduced in size and weight, it is necessary to supplement the force of gravity holding it against the drum by a pressure plate 26 which, in the operating position (FIG. 3), is pressed against the upper surface of the meat block by manual force applied to a handle 28. The foregoing construction provides a manually loaded meat flaking machine for use for reducing frozen (tempered) meat blocks to flakes by supermarket meat departments, butcher shops and other retail meat suppliers for whom the much larger types of flaking machine used by meat wholesalers and the like would not be suitable.

Figure 5:
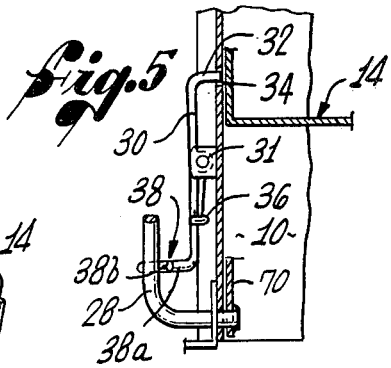
FIG. 5 is a cross sectional view showing the same portion of the equipment as in FIG. 4 but with the locking arm in a withdrawn position.
Figure 4:
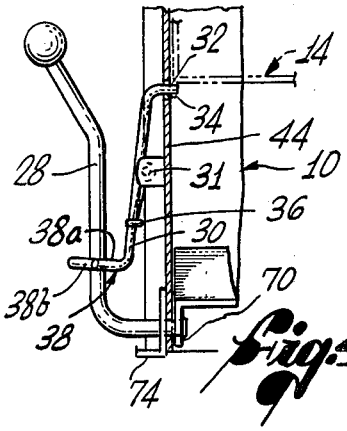
FIG. 4 is a cross sectional end view of a portion of the flaking machine shown in FIG. 3 taken along the lines 4—4 therein showing a mechanical locking arm forming a part of the present invention, with the arm pivoted to a locking position.

A valuable feature of the machine resides in the provision of a mechanical interlock which ensures that a block of meat cannot be loaded into the charging chamber on top of the pressure plate 26 while it is in operating position, a situation which could otherwise jam the charging chamber preventing passage of the meat out to the cutting drum or re-opening of the loading tray to withdraw the meat to clear the obstruction. Such mechanical interlock (FIGS. 4 and 5) includes a vertical arm 30 connected adjacent to mid point by a privotal connection 31 to the exterior of one side wall of the upper housing 10. At its upper end, the arm 30 is bent over to form a detent 32 aligned with an opening 34 in the side wall through which the detent can be moved into a blocking position projecting into the path of the loading tray 14 between its loading and charging positions (FIG. 4). The arm 30 is continuously urged to the blocking position by a spring 36 connected between the arm and the connection 31. At its opposite end, the arm 30 is provided with an horizontal, V-bent portion 38 constituting a cam which projects into the path of movement of the handle 28.

When the handle 28 is placed in its nonuse position (FIG. 2) to move the pressure plate out of the way of meat entering the charging chamber, the lower portion of the handle is in contact with the cam 38 thereby pivoting the lower portion of the arm 30 towards the housing and withdrawing the detent 32 from the path of the loading tray 14. The loading tray can thus be moved to the charging position to cause the block of meat to enter the charging chamber. However, when the arm 28 is subsequently pulled towards the front of the machine by the operator to apply pressure to the top of the meat block, the handle moves out of contact with the cam 38 so that the spring 36 moves the detent into its blocking position. The loading tray cannot, thereafter, be returned to the loading position until the handle 28 has been moved back to its nonuse position to return the pressure plate to its inoperative position. With this interlock system, the possibility of jamming the machine by inserting a block of meat on top of the pressure plate while it is in the operating position, is avoided. This precaution is particularly necessary when it is realized that the operators of such equipment in a supermarket or butcher shop are often mechanically unskilled and a foolproof system is necessary.

In more detail, the upper housing 10 comprises a rectangular cabinet having front and rear walls and side walls. At its lower end the cabinet is secured to a rectangular, horizontal base plate 46 which rests upon a horizontal rim 48 extending about the periphery of the upper end of the lower housing 20. An outlet opening 50 is provided in the upper base plate to enable the block of meat to enter the passageway in the lower housing. The front wall of the upper housing is cut away along the major portion of its length to provide the entrance opening 12 and a conventional pivotal mounting 54 connects the upper edge of the front wall and the underside of the loading tray 14 for vertical pivoting motion.

The loading tray 14 has a base wall 56 extending across the entrance opening 12 and is provided with vertical side walls 58 which locate the meat on the tray. In the loading position, shown in FIG. 2, the loading tray is supported at one point by the pivotal connection 54 and, adjacent its outer end, by a support bracket 60 which extends downwardly from the underside of the base 56 into contact with adjacent portions of the upper housing 10. A block of meat placed on the loading tray in the loading position is prevented from sliding out by a vertical end wall 64.

To raise the loading tray from the loading position (FIG. 2) to the charging position (FIG. 3) the operator grasps a handle 66 secured to the loading tray adjacent the end wall 64 and raises it upwardly to pivot the loading tray about the pivot point 54. A reversely bent lip 68 on the loading tray enables the operator to change his grip on the loading tray as it approaches the charging position, and retain control over its movement.

Figure 2:
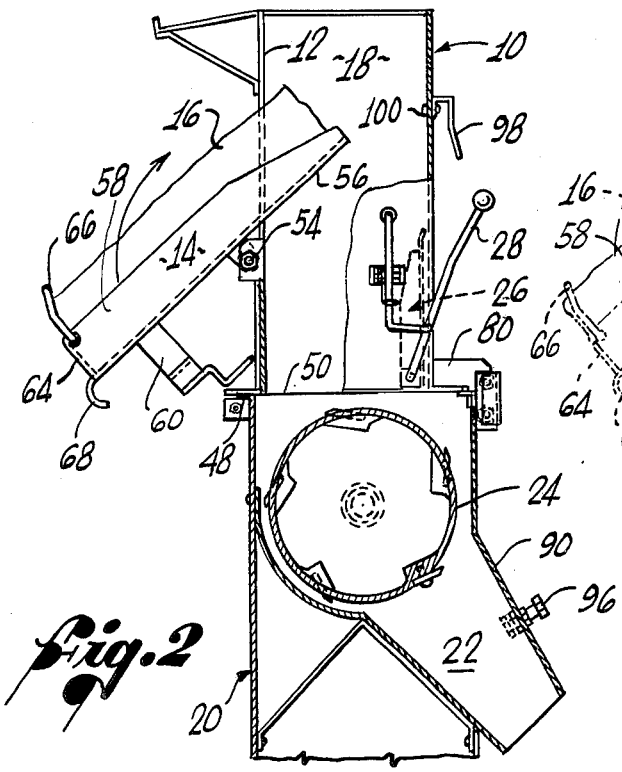
FIG. 2 is a cross sectional, side view through the flaking machine shown in FIG. 1 with a pressure plate, forming a part of the invention, shown in an inoperative position and with a loading tray shown in a loading position.
Figure 3:
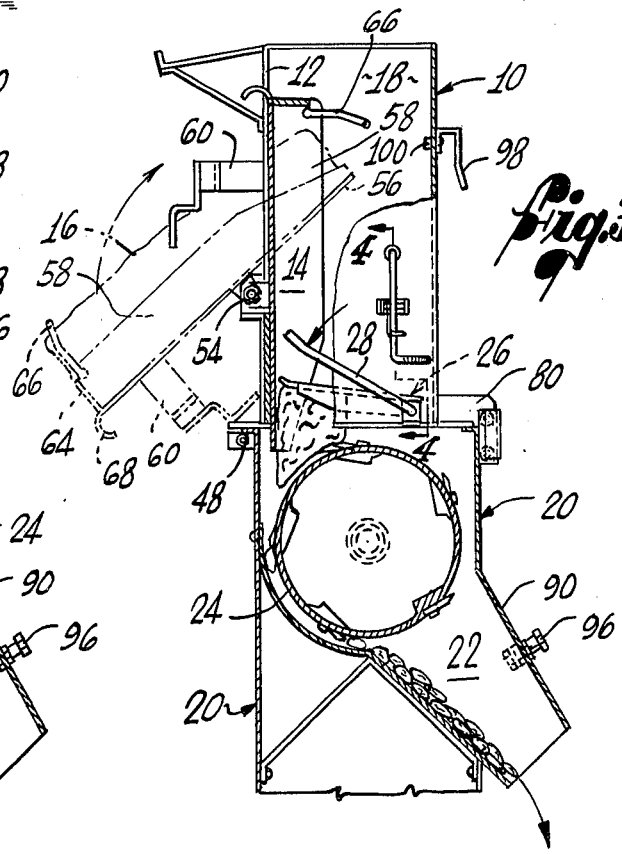
FIG. 3 is a cross sectional side view corresponding to that shown in FIG. 2 but with the loading tray shown (in full lines) in a charging position and with the pressure plate shown in an operating position.

Initially, the weight of the meat block will be sufficient to hold it in contact with the cutting drum as the block passes out of the charging chamber under gravity. As the block becomes progressively reduced in size, thereby reducing its weight, a point is eventually reached when additional pressure needs to be applied to the top of the meat block to press it against the cutting drum. The pressure plate 26, previously referred to, is a flat metal plate corresponding in its general dimensions to the cross sectional area of the charging chamber (allowing for clearance from the walls) and has strengthening ribs 70 secured along its opposite transverse edges. One of the ribs 70 is connected by a conventional pivot connection to the adjacent side wall of the housing 10 and an outside strengthening bracket 72 (FIG. 1). The other rib 70 (FIGS. 4 and 5) is fixedly secured to the horizontally bent, inwardly projecting lower end of the handle 28. The handle 28 passes outwardly through an opening in the adjacent sidewall 44 and through a journal bearing in a bracket 74 secured to the upper housing and to the upper base plate 46, and then extends upwardly. Turning movement is imparted to the pressure plate by manual force applied to the handle. As seen in FIG. 2 the handle is upright but angled rearwardly from the upper housing when the pressure plate is in the inoperative position.

The previously referred to cam 38, forming a part of the mechanical interlock, is constituted by a horizontal V-bend in the lower end of the arm 30 having an outwardly bent, forward region **38*a* and a reversely bent, rearward region 38*b*. When the pressure plate 26 is in the inoperative position, the lower portion of the handle 28 is in contact with the rear region 38*b* of the cam and presses the lower end of the arm 30 towards the housing to maintain the detent 32 in the withdrawn position (FIG. 5) against the action of the spring 36. When the handle 28 is pulled forwardly it moves past the apex of the V-shaped cam and then beyond the forward portion 38*a* after which the spring 36 rotates the upper part of the arm 30 towards the housing to project the detent 32 through the opening 34** into its blocking position.

On reverse movement of the handle 28 back to the nonuse position, it comes into contact with the forward region **38*a* of the cam depressing the lower portion of the arm 30 towards the housing and withdrawing the detent. Further reverse motion of the handle bring it to its nonuse position resting against the portion 38*b* of the cam with the detent still withdrawn. It will be appreciated that the use of the V-shaped cam gives an over center retaining action preventing the handle 28** from moving out of position accidentally.

Figures 6, 7, 8, 9:
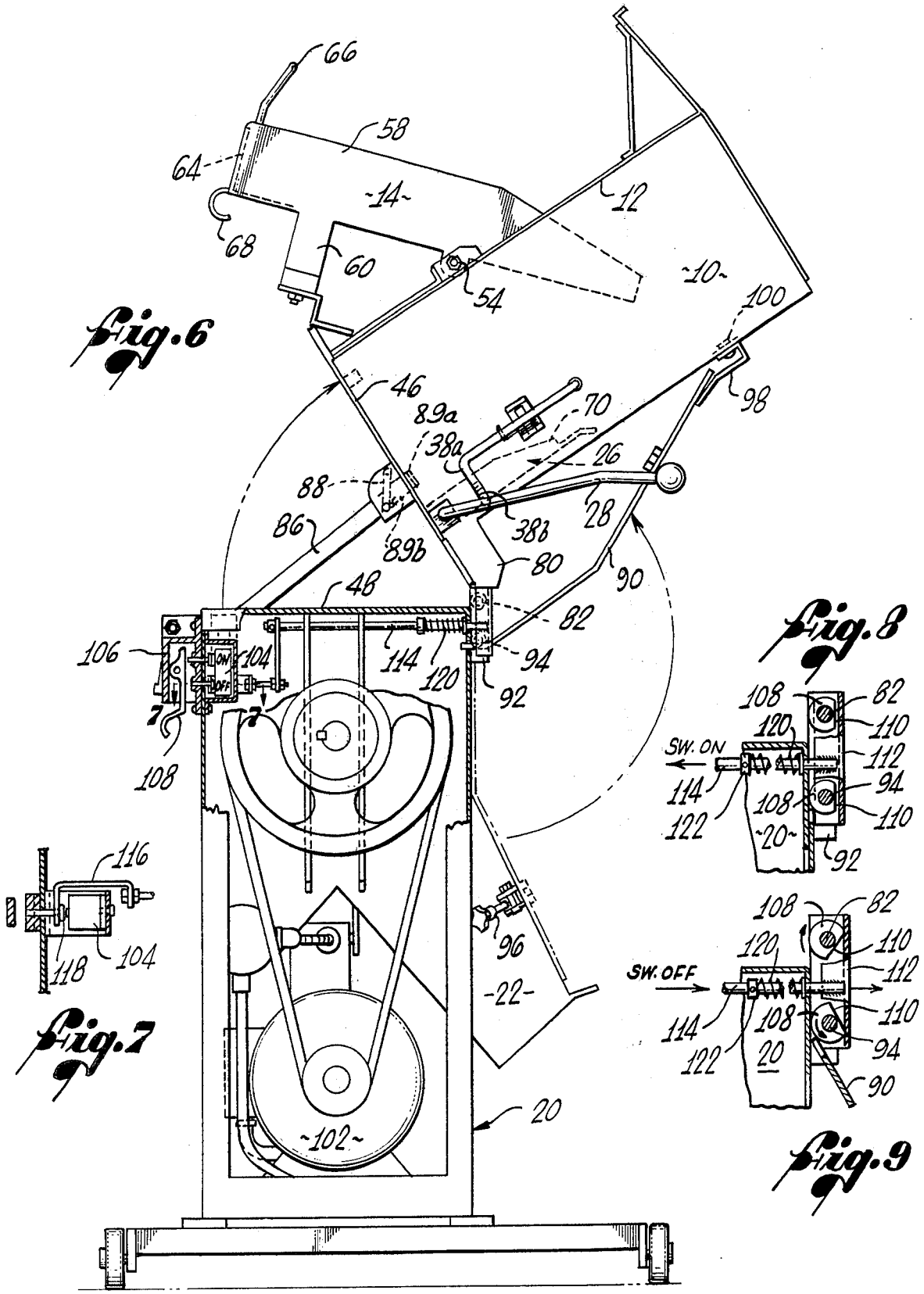
FIG. 6 is a side view, partially in cross section, of the flaking machine shown in FIG. 1 but with portions of the machine pivoted to a cleaning position to expose the interior.
FIG. 7 is a cross sectional view of a portion of an electrical switch system shown in FIG. 6 taken along the lines 7—7 therein.
FIG. 8 is a cross sectional side view of an enlarged portion of a switch interlock system forming a part of the invention shown in FIG. 6 with the parts in the position they occupy when the switch is in an ON position.
FIG. 9 is a view of the same portion of the machine shown in FIG. 8 but with the parts in the position they occupy when the switch is in an OFF position.

The present machine is particularly adapted for ease of access for cleaning. For this purpose, the upper housing 10 is pivotally connected to the lower housing 20 by a pair of hinges 80 (FIGS. 1 and 2) secured to the upper side of the upper base plate 46 extending away from the rear wall of the upper housing. At their outer ends, the hinges 80 have axles 82 which are mounted in conventional bearings secured to the lower housing. In this way, the upper housing can be hinged upwardly, as shown in FIG. 6, to expose the charging chamber, the interior of the lower housing and the cutting drum for cleaning. To hold the upper housing 10 in the cleaning position, a retaining bar 86 is connected by a pivotal connection (FIG. 1) to the forward upper corner of the lower housing and extends slidably through a slanted U-shaped bracket 88 secured to the upper base plate 46 (FIG. 6). At its free end the bar 86 is provided with a curled over portion **89*a* which abuts against the upper surface of the upper base plate 46 in the cleaning position to prevent further pivoting motion and support the upper housing. To prevent the upper housing from accidental dropping forward during cleaning, the underside of the retainer bar 86 is provided with a cut out notch 89*b* which is engaged by the U-shaped bracket 88 if the housing starts to fall forwardl to arrest closing. To close the housing intentionally, it is necessary to raise the retainer bar 86 by hand so that the bracket 88 can clear the notch 89*b***.

Access to the interior of the lower housing 20 for cleaning is provided by a lid 90 forming a part of the rear wall of the lower housing. The lid 90 is connected by a hinge 92 to an axle 94 mounted in a conventional bearing secured to the lower housing adjacent its upper end. The lower portion of the passageway 22 is formed by four walls which provide an outwardly and downwardly inclined chute. A removable tray (not shown) is placed beneath the chute to collect the flakes. The lid 90, in its lower region, is outwardly angled to constitute the upper wall of the chute. Releasable clamps 96 connect the lid to the side walls of the chute and allow for release of the lid so that it may be hinged upwardly for cleaning, at which time the cutting drum is also exposed. To hold the lid out of the way while cleaning is in progress, a conventional latch 98 is provided on the upper housing which may be swiveled sidewardly about a connecting pin 100 to receive the edge of the lid 90 and then turned downwardly to retain the lid in its out-of-the-way position (as shown in FIG. 6).

To avoid operator injury from the cutting drum while either the upper housing 10 or the lid 90 is in its raised cleaning position, an electrical safety system is provided. As shown in FIG. 7, the cutting drum 24 is driven, via a conventional belt drive, by an electric motor 102 mounted in the lower part of the lower housing 20. The cutting drum itself is of similar construction to that shown in the earlier Lasar U.S. Pat. No. 3,530,914. Electrical power is connected, from an external source, to the motor through a conventional motor control switch 104 having two, vertically spaced, press buttons, an ON button and an OFF button. The switch 104 is mounted in the upper forward region of the housing with the switch buttons projecting through the housing into a switch housing 106 which contains a vertically pivoting lever 108. Outward finger pressure applied to the free lower end of the lever 108 pivots the upper end of the lever against the ON button to switch the motor on while pressure in the opposite direction causes the lever to press against the OFF button to turn the motor off.

The present invention includes an arrangement for depressing the OFF button whenever the upper housing 10 or the lid 90 are pivoted away from their closed positions. For this purpose, each of the axles 82 and 94 hingedly connecting the upper housing and the lid with the lower housing, respectively, is provided with a generally circular cam 108 (FIG. 8) having a flat portion 110 positioned within a U-shaped channel member 112. The flat portions 110 face towards the web of the U-shaped channel member 112 when the housing and the lid are in the closed position. The U-shaped channel member is fixedly secured to a rod 114 which is slidably mounted within and extends through the lower housing. At its forward end, the rod is connected to a U-shaped toggle 116 which is provided with a slot which extends around the plunger of the OFF button on the power switch 104 and abuts against a collar 118 fixedly secured to the OFF button plunger. A compression spring 120 is mounted between the interior of the lower housing and a collar 122 secured to the rod 114, to resiliently bias the channel member into continuous contact with the cams 108. When both the housing and the lid are in their closed positions, the U-shaped channel 112 is in its closest relation to the upper housing at which time the forward end of the toggle 116 is spaced sufficiently away from the switch 104 to enable the OFF plunger to be in the extended position it occupies when the ON button is depressed and power is applied to the motor.

Raising either the lid 90 or the upper housing 10 causes the associated one of the cams 108 to rotate, as shown in FIG. 9, bring the rounded portion of the cam against the web of the channel member and moving it relatively away from the housing. Such movement causes the rod 114 to pull the toggle 116 against the collar 118 on the OFF button plunger to depress the same and disconnect power from the electric motor. With this arrangement, the motor is automatically inactivated whenever either the upper housing 10 or the lid 90 of the lower housing are raised to their cleaning position.

It will be appreciated from the foregoing description that a meat flaking machine constructed in accordance with the preferred embodiment of the invention is suitable for use by butcher shops, supermarket meat departments and the like, which require a manually loaded machine for flaking meat. The construction described minimizes the opportunity for unskilled labor to jam or otherwise render the machine inoperative. Furthermore, the machine facilitates cleaning by providing easy access to its interior parts and includes safety features to ensure that whenever the equipment is placed in its cleaning position exposing the cutting drum, the latter is inactivated from motion.

Although the invention has been described with reference to the preferred embodiment, it will be understood that changes may be made without departing from the spirit of the invention defined by the appended claims.

I claim:

1. A meat flaking machine for reducing a block of meat to meat flakes comprising, a lower housing having a vertically extending passageway therethrough, a power driven cutting drum rotatably mounted in said lower housing extending across said passageway for cutting the block of meat into flakes, an upper housing mounted on said lower housing having a vertically extending charging chamber communicating with said passageway, said upper housing further including a vertical entrance opening communicating with said charging chamber, a loading tray movably connected with said upper housing for movement along a path between, a loading position in which an inner end of said loading tray extends through said entrance into said charging chamber with the remainder of said loading tray projecting outwardly from said upper housing to receive and support the block of meat, and a charging position in which said loading tray extends along said entrance opening to position the block of meat within the charging chamber whereby, the block of meat enters the passageway and contacts said cutting drum;

a pressure plate movably connected to said upper housing positioned within said charging chamber for motion between, an inoperative position extending along the charging chamber spaced oppositely from the entrance opening, and an operative position extending across the lower end of the charging chamber adapted to contact the upper end of the block of meat as it moves through the lower end of said charging chamber;

a handle connected to said pressure plate positioned externally of said upper housing, said handle adapted to be grasped manually for movement along a path between a nonuse position locating said pressure plate in its inoperative position and a use position locating said pressure plate in the operative position whereby manual force applied to the handle presses the block of meat against the cutting drum; and mechanical interlock means connected to said upper housing responsive to the position of said handle for preventing movement of said loading tray between the loading and the charging position when said pressure plate is out of its inoperative position.

2. A meat flaking machine as defined in claim 1 wherein said interlock means include an arm pivotally connected intermediate its ends to said upper housing positioned externally thereof, a detent secured to one end of said arm aligned with an opening through said upper housing, said detent being moved by pivoting of said arm between a blocking position projecting through said opening into the path of said loading tray to prevent movement thereof between its loading and charging positions and a withdrawn position out of such path; and a cam secured to the opposite end of said arm positioned in the path of movement of said handle between the nonuse and use positions thereof, said handle, upon movement to its nonuse position, contacting said cam to pivot said arm in a direction such as to move said detent to the withdrawn position thereof.

3. A meat flaking machine as defined in claim 2 further including spring means connected to said arm and said upper housing for urging said detent from the withdrawn position to the blocking position whereby, upon movement of said handle out of the nonuse position, said detent is moved to its blocking position.

* * * * *